United States Patent [19]

Huscher

[11] Patent Number: 4,523,761

[45] Date of Patent: Jun. 18, 1985

[54] METHOD AND APPARATUS FOR RATING HITS ON TARGETS

[76] Inventor: Georg Huscher, Ottobeurer Str. 31, D-Markt Rettenbach, Fed. Rep. of Germany

[21] Appl. No.: 496,319

[22] PCT Filed: Aug. 24, 1982

[86] PCT No.: PCT/DE82/00168

§ 371 Date: Apr. 28, 1983

§ 102(e) Date: Apr. 28, 1983

[87] PCT Pub. No.: WO83/00920

PCT Pub. Date: Mar. 17, 1983

[30] Foreign Application Priority Data

Sep. 1, 1981 [DE] Fed. Rep. of Germany ..... 3134561

[51] Int. Cl.[3] ..... F41J 5/02

[52] U.S. Cl. ..... 273/371; 273/408; 226/20

[58] Field of Search ..... 273/371, 378, 348, 408; 250/262, 263; 226/20, 45

[56] References Cited

U.S. PATENT DOCUMENTS

| | | | |
|---|---|---|---|
| 3,700,909 | 10/1972 | Murray et al. | 250/562 |
| 3,786,265 | 1/1974 | Abilock et al. | 250/572 |
| 3,835,332 | 9/1974 | Bridges | 250/563 |
| 4,075,498 | 2/1978 | Takasuka et al. | 250/562 |
| 4,247,116 | 1/1981 | McQuary | 273/408 |
| 4,427,199 | 1/1984 | Faith | 273/371 |

*Primary Examiner*—Richard C. Pinkham
*Assistant Examiner*—Leo P. Picard
*Attorney, Agent, or Firm*—Kuhn Muller and Bazerman

[57] ABSTRACT

Apparatus for rating hits on a target comprises two photoelectric detector systems 1, 3. One of said systems is held in position adjacent to the path of travel of a target and is used to measure the distance from an entry hole to the center of the bull's eye of the target in the direction in which the target 18 travels through the apparatus. The other system is mounted on a cross slide 8, which is movable at right angles to the direction of travel of the target and measures the distance from the center of the entry hole to the center of the bull's eye in that transverse direction. The two distance vectors are vectorially summed up by a vector computer and are multiplied with a calibration factor. The result of the measurement may then be displayed, printed or delivered to an electronic data processing system in the form of a tenth-of-a-ring rating.

15 Claims, 5 Drawing Figures

METHOD AND APPARATUS FOR RATING HITS ON TARGETS

The targets used in firing practice have a number of concentric rings and a centrally disposed, dark bull's eye. The distance from the center of the bull's eye to the entry hole is measured with the eye.

It is an object of the invention to provide a method and apparatus for an automatic rating of hits on targets so that subjective errors in measurement will be avoided, a more accurate rating is ensured and the time required for the rating is reduced.

The invention resides basically in that an individual target sheet or a web provided with a plurality of targets is moved through a first photoelectric detector system, which generates in the direction of web travel x a hole center signal Lx and a bull's eye center signal Sx. The means for driving the web generate travel pulse signals Ix, which are proportional to the travel of the web. A pulse-controlled gating circuit transmits only those travel pulses which occur between the times at which the signals Lx and Sx occur. These travel pulses are counted to obtain a total travel pulse count X. A second photoelectric detector system, which corresponds to the first and has a light path which is at right angles to that of the first photoelectric detector system, is moved relative to the target transversely to the direction of travel of said target and travel pulses representing the travel in the direction y of that transverse movement and occurring between the times at which a hole center signal Ly and a bull's eye center signal Sy occur are summed up to form a total count Y. The total counts X and Y are applied to a vector computer, which computes the parameter $r=\sqrt{X^2+Y^2}$, wherein r is proportional to the distance from the center of the entry hole to the center of the bull's eye. That parameter r is multiplied with an adjustable calibrationing factor. The result is indicated as a ring rating, e.g., a tenth-of-a-ring rating, and/or is delivered to a printer or an electric data processing system.

To generate the center signals, edge signals representing mutually opposite edge portions of a hole are generated. The accuracy of this rating is higher by a factor of 10 than the accuracy of a manual rating and the rating takes only about 1 second.

An illustrative embodiment is shown on the drawing.

Figure 1:
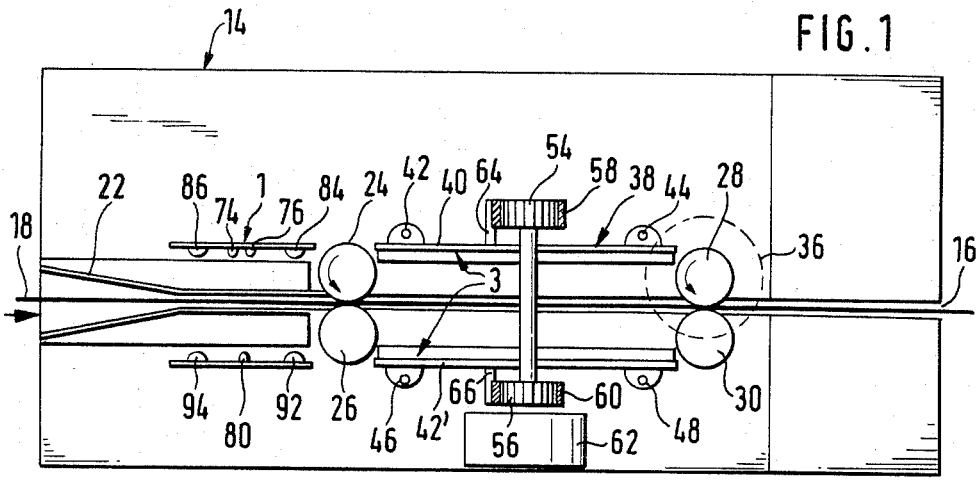
FIG. 1 is a side elevation showing the rating apparatus.
Figure 2:
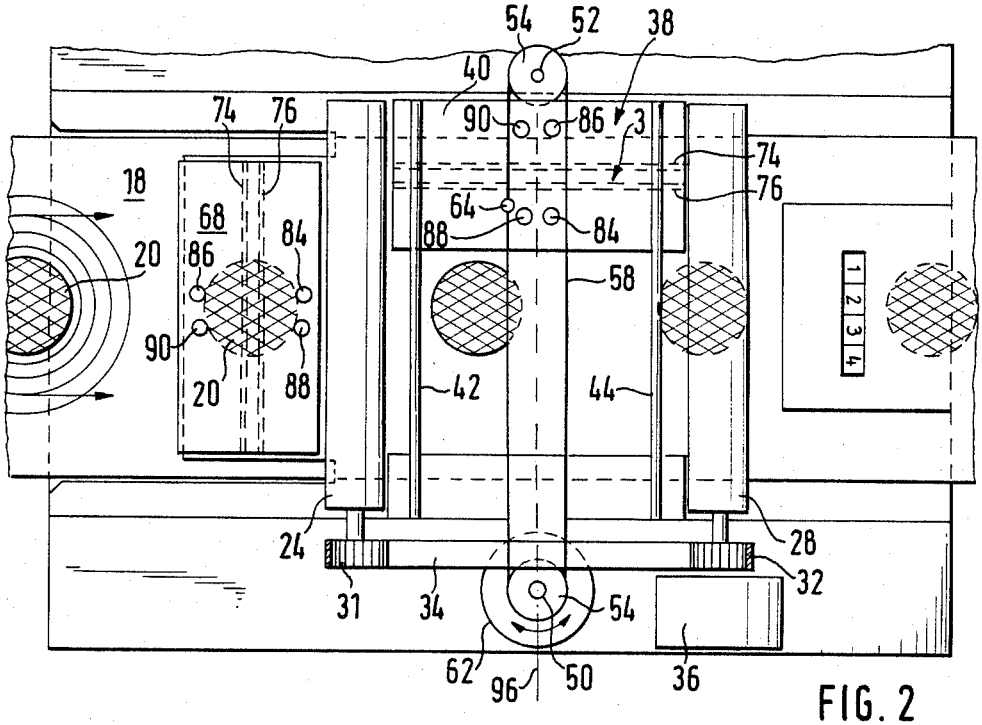
FIG. 2 is a diagrammatic top plan view showing the apparatus of FIG. 1.

The apparatus for rating hits on targets comprises a prismatic housing 14, which has on the front side a tapering entrance slot 22 and in the opposite housing wall an exit slot 16. A target web 18, which is provided with a plurality of targets having outer rings and a central bull's eye 20, is inserted into the slot 22 and before being engaged by a pair of feed rollers 24, 26 moves successively through two photoelectric detector systems 1 and 3. A second pair of rollers 28, 30 are provided between the photoelectric detector systems 1 and 3 and serve for a rating of hits on individual target sheets. The roller 28 is directly driven by a drive motor 36, which is connected to a stepping pulse generator 2. The two rollers 24, 28 carry gears 31, 32 and are synchronized by a toothed belt 34.

Figure 5:
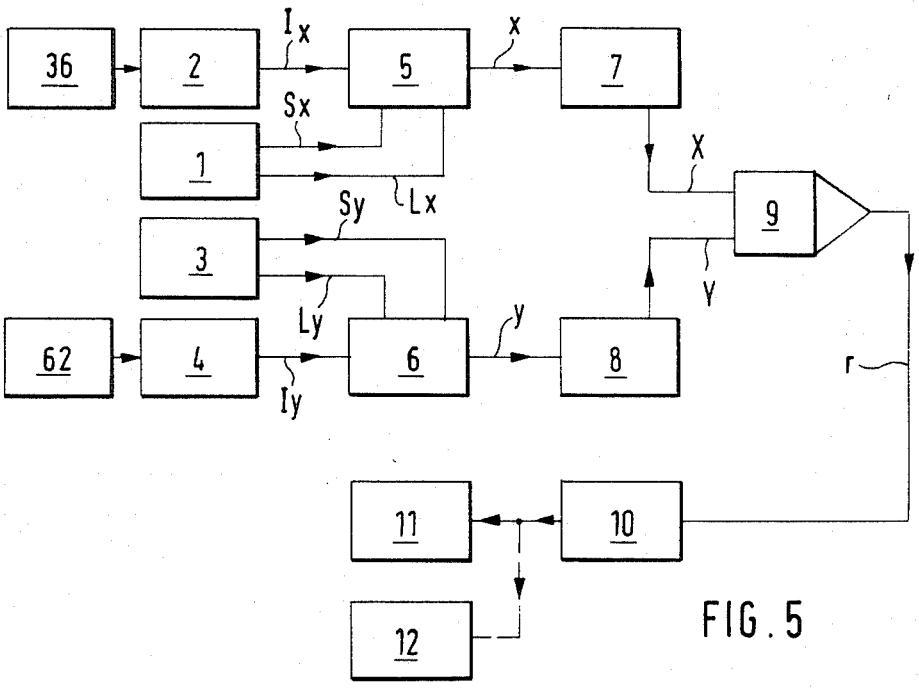
FIG. 5 is a circuit diagram showing the various electronic components.
Figure 4:
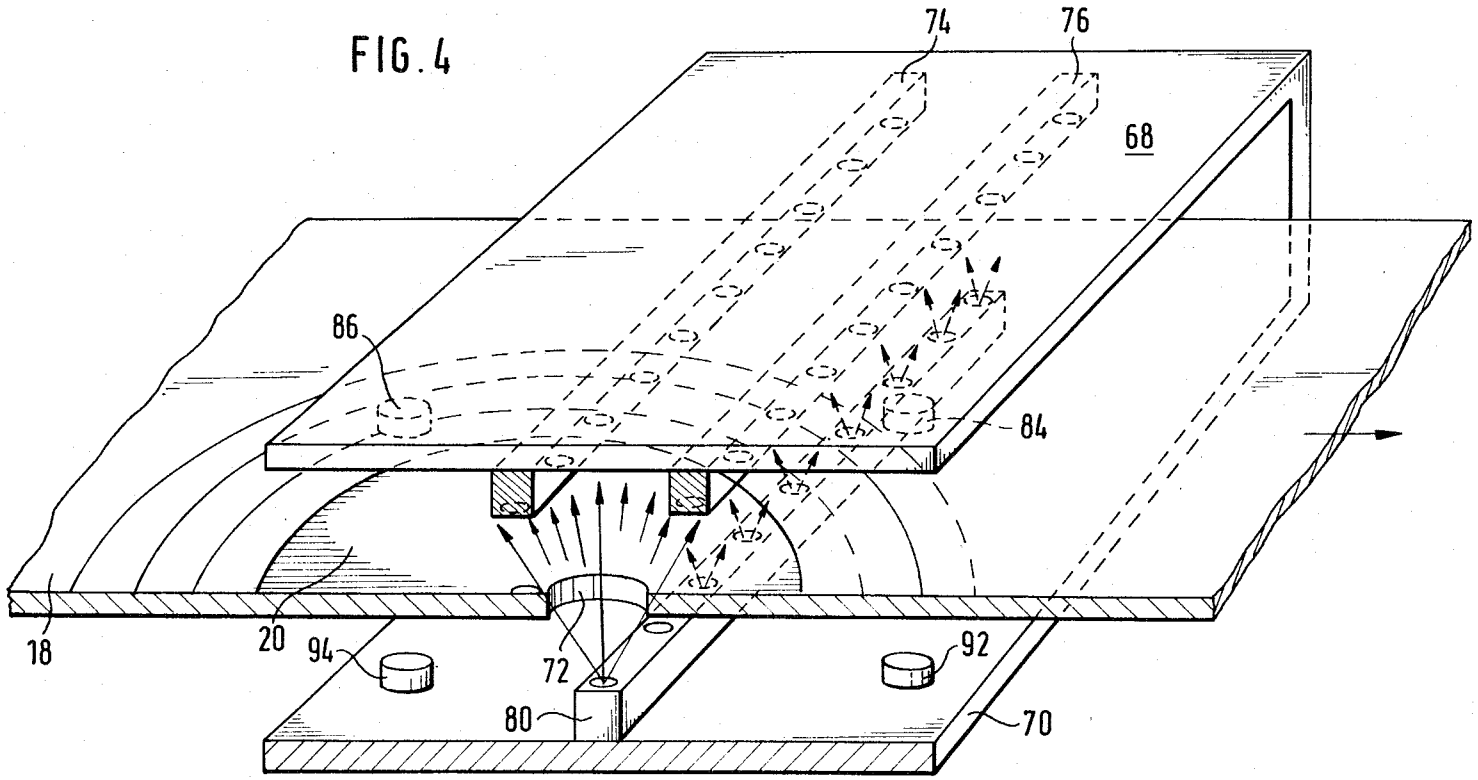
FIG. 4 is a perspective view showing one half of a stationary photoelectric detector system, which is disposed in front of the first pair of feed rollers.

The second photoelectric detector system 3 is mounted on a transversely movable cross slide 38, which comprises a top plate 40 and a bottom plate 42'. The two plates 40 and 42' are slidably guided independently of each other on guide rods 42, 44 and 46, 48, respectively, which are fixed in the housing. Outside the path of the target web 18, a vertical drive shaft 50 is rotatably mounted on one side and a reversing shaft 52 is rotatably mounted on the other side. The two shafts carry upper and lower gears 54, 56. A toothed belt 58 is trained around one of the upper gears 54 and the associated lower gear 56. A second toothed belt 60 is trained around the other upper gear 54 and the associated lower gear 56. The drive shaft 50 is directly connected to a drive motor 62, which is also provided with a stepping pulse generator 4 (FIG. 5). The motor 62 is reversible. Each of the toothed belts 58, 60 has a coupling pin 64 or 66, which engages corresponding bores in the plate 40 or 42', respectively, so that said plates 40 and 42' can be reciprocated by the motor 62 in mutually opposite directions across the path of travel of the web 18.

The photoelectric detector system 1 comprises a top plate 68 and a bottom plate 70. These two plates are equal in size and extend across the target web 18. The length of each plate is at least as large as the diameter of the largest ring of the target. The two plates 68, 70 are spaced about the same distance apart from the plane of travel of the web 18. That distance is about 2 to 5 times the diameter of an entry hole 72. Two linear arrays 74, 76 of phototransistors are provided on the underside of the top plate 68 and are spaced apart by a distance which is about as large as twice the diameter of the entry hole. These linear arrays 74, 76 extend substantially throughout the length of the plate 68. In the vertical plane of symmetry 78 associated with these two linear arrays 74, 76, a linear array 80 of light sources consisting of a multiplicity of closely spaced diodes or transistors is disposed.

As the web 18 moves in the direction of the arrow 82, the receivers of the array 74 first receive light from the light sources of the array 80 through the entry hole 72. As soon as the receivers of the two arrays 74, 76 receive the same brightness, a comparator circuit known per se generates a signal Lx, which is the so-called hole center signal, for the movement in the direction of travel of the web.

Figure 3:
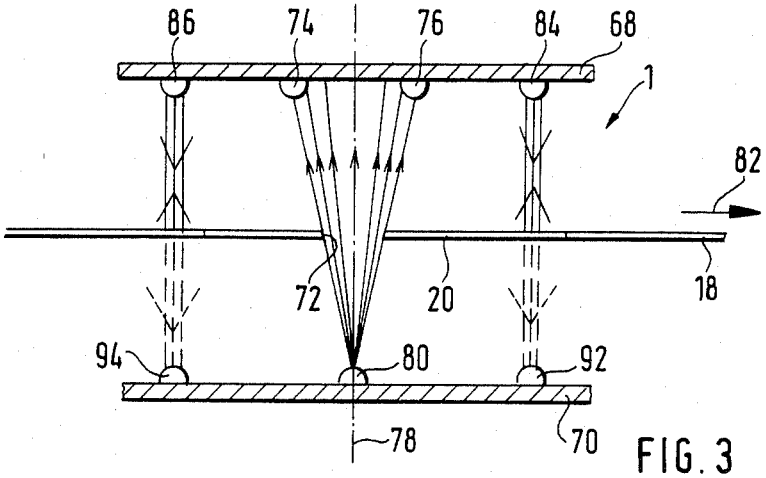
FIG. 3 is a diagrammatic representation of the arrangement and function of one of two photoelectric detector systems which are employed.

In a manner which is similar to the generation of the hole center signal Lx, the photoelectric detector system 1 generates a signal Sx when the target web 18 is advancing and the center of the bull's eye 20 reaches the vertical plane 78. For this purpose, two photoelectric detector systems 84, 86 for detecting reflected light are provided on the underside of the top plate 68 and in the direction of travel have a spacing which is approximately as large as the diameter of a bull's eye 20. These photoelectric detector systems of detecting reflected light are not linear but button-shaped and consist each of a light source and an integrated light receiver. Because the bull's eye is black and is surrounded by a white surface, the photoelectric detector system 86 for detecting reflected light will receive more light than the photoelectric light detector 84 when the bull's eye 20 is in the position shown in FIG. 3 because more light is reflected by the white surface. As the bull's eye 20 moves through the pair of photoelectric light detectors 84, 86, they will receive the same brightness when the bull's eye 20 is on the left of the position shown in FIG. 3. The reception of equal brightnesses by the photoelectric detectors 84, 86 is also processed in a comparator circuit to form said bull's eye center signal Sx.

The two photoelectric detectors 84, 86 for detecting reflected light may be disposed in the central vertical longitudinal plane of the path of travel of the web. It is preferred, however, to provide a second pair of photoelectric detectors 88, 90 for detecting reflected light, which correspond to the photoelectric detectors of the first pair 84, 86, and to arrange the detectors of one of said pairs on one side and those of the other pair on the other side of that vertical longitudinal center plane. Each of the four photoelectric detectors 84 to 90 for reflected light has also associated with it a phototransistor 92 or 94, which is disposed on the upper surface of the lower plate 70 of the photoelectric detector system 1 on the axis of the light ray emitted by the light source. If the entry hole 72 is disposed in the bright region adjacent to that edge portion of the bull's eye which is supposed to diffusely reflect light to the receivers of the photoelectric detectors 84, 86 for detecting reflected light, then a wrong bull's eye center signal could be generated. This will be avoided if the light which has been emitted by the photoelectric detectors 84, 86 and passed through an entry hole 72 in the reflecting region is incident on the receiver 92 or 94 disposed underneath. That receivers will then generate a signal that suppresses the hole center signal of these two photoelectric detectors 84, 86 and effects a change over to the bull's eye center signal Sx generated by the photoelectric detectors 88, 90 of the other pair. These are responsive to light reflected by the region which is adjacent to the opposite edge portion of the bull's eye and has no entry hole.

The photoelectric detector system 3 is exactly like the system 1 but is mounted on the cross slide 38 and oriented at right angles to the photoelectric detector system 1. When a bull's eye center signal Sx has been generated in response to the movement of a bull's eye 20 through the photoelectric detector system 1, the motor 36 will be stopped at that instance in which the stepping pulses count indicates that the center of the bull's eye has reached approximately the central vertical transverse plane 96 of the cross slide 38. This causes the motor 62 to start and move the cross slide 38 at right angles to the direction of travel of the web 18 over a distance which is at least as large as the outside diameter of the target. In a manner which is similar to the function of the system 1, the photoelectric detector system 3 generates the target center signal Sy and the entry hole center signal Ly. The two pulse generators 2 and 4 of the motors 36 and 62 continually generate pulses Ix and Iy as long as the motors are running.

The travel pulse signal Ix, the hole center signal Lx and the bull's eye center signal Sx are delivered to a pulse-controlled gating circuit 5, which under the control of the pair of signals Lx and Sx transmits pulses only in a number which corresponds to the x coordinate from the center of the hole to the center of the bull's eye. In a similar manner, a gating circuit 6 is used to derive the y coordinate of said center spacing from the signals Sy, Ly and Iy. The transmitted x pulses are counted and the resulting count is stored in a counter-buffer 7. The y pulses which have been transmitted are correspondingly processed in the counter-buffer 8. The total pulse counts X and Y from the buffers 7, 8 are delivered to a vector computer 9, which from the parameters X and Y computes the parameter $r=\sqrt{X^2+Y^2}$ so that the parameter r is proportional the distance from the center of the bull's eye to the center of the entry hole. The r signal is multiplied with an adjustable calibration factor and decoded in the circuit 10 to provide the tenth-of-a-ring rating, which constitutes the result of the measurement. That ring rating is delivered to a printer 11 or an electronic data processing system 12. The printer 11 may be a counting printer for summing the results of measurement (ring ratings) ascertained from the several targets of the web 19.

A more compact arrangement will be obtained and the linear arrays 74, 76 of photoelectric detectors of both systems 1, 3 will be at right angles regardless of their assembling if both photoelectric light detector systems 1, 3 are mounted on the cross slide 38, which in that case must be held in position as long as the x signals are generated. In that case only the slide movement in one direction can be utilized for the measurement.

In an alternative embodiment, the photoelectric detector systems 1, 3 are so designed that the phototransistor cell 76 is omitted and the remaining phototransistor cell 74 for the generation of the hole edge signals is vertically aligned with the linear series 80 of the light sources. When a predetermined threshold level has been reached at an edge portion of the hole, the pulses representing the travel of the target web or slide are counted until the same threshold level has been reached at the opposite edge portion of the hole. The number of travel pulses is divided by two to ascertain the center of the hole. The same concept is desirably adopted to generate the bull's eye center signal. That pair of photoelectric detectors 84, 88 for detecting reflected light which in the direction of travel of the target 18 or slide 38 succeed respective phototransistor cells of the pair 74, 80, are eliminated. The first bull's eye edge signal is stored by the bull's eye edge sensor 86 or 90 as the bright-dark boundary passes and a predetermined threashold level has been reached. The travel pulses are counted until the same threshold value is detected by the same sensor 86 or 90 as the bright-dark boundary on the opposite edge of the bull's eye passes. It is essential that the first bull's eye signal initiates the counting of the both pulse trains used to ascertain the difference between the coordinates of the bull's eye center and the hole center. For this reason, each of the bull's eye edge sensors 86 and 90 must be spaced in the direction of movement of the target or of the slide 38, respectively, from the pair of linear arrays 74, 80 of hole sensors. In the computation of the difference, that spacing is taken into account in the form of a corresponding constant number of pulses.

I claim:

1. A method of rating hits on targets having a bull's eye, wherein the Cartesian coordinates of the entry holes are measured by means of two mutually orthogonal photoelectric detector systems, characterized in that the target is moved in a predetermined direction relative to and through the first photoelectric detector system, by which two mutually opposite hole edges are detected and the resulting signals are compared to provide a hole center signal (Lx) and the bright-dark boundaries at the mutually opposite edges of the bull's eye are detected to provide two bull's eye edge signals, from which a bull's eye center signal (Sx) is derived, travel signals (Ix) which are proportional to the relative travel of the target are generated and the differential travel (X) between the relative target positions at the time of the bull's eye center signal (Sx) and the hole center signal (Lx) is counted and the count is stored in a counter-buffer, the central region of the bull's eye and the second photoelectric detector system (3) are aligned in a direction which is transverse to the direction of relative travel, the second photoelectric detector system is moved in the transverse direction relative to the target while its alignment is maintained and during that movement the differential travel (Y) derived from the bull's eye central signal (Sy), the hole center signal (Ly) and the travel signals (Iy) is counted and the count is stored, and the parameter $r=\sqrt{X^2+Y^2}$ which is proportional to the rating is computed from the two differential travels (X, Y).

2. A method according to claim 1, wherein the step of moving the target is carried out by a target feeder accommodated in a housing with a travel pulse generator associated with said feeder, and movement of the second photoelectric detector system is carried out on a cross slide spaced from the first photoelectric detector system, which is adapted to be reciprocated transversely to the direction of movement of the target with a travel pulse generator associated with said cross slide drive means.

3. A method according to claim 2 wherein each photoelectric detector system for generating a hole center signal has a linear array of light sources directed on one side of the path of travel of the target and at least one linear array of light receivers on the other side of said path.

4. A method according to claim 3, wherein two parallel linear arrays of light receivers, which have a spacing that is approximately twice the diameter of the entry hole, and the linear array of light sources are used for generating a hole center signal for each photoelectric detector system.

5. A method according to claim 3 wherein two parallel linear arrays of light receivers which have a spacing that is about twice the diameter of the entry hole and the linear array of light sources are used for generating a hole center signal for each photoelectric detector system.

6. A method according to claim 2 wherein at least one photoelectric detector which is disposed on one side of travel of the target serves to detect reflected light which is included to provide a bull's eye center signal by each photoelectric detector system.

7. Apparatus for rating hits on targets comprising in combination:

(a) a target feeder accommodated in a housing having means for conveying a target in a predetermined direction and a travel pulse generator associated with said feeder;

(b) a first photoelectric detector system adjacent the path of travel of said target including means for detecting two mutually opposite hole edges of a target moving in a predetermined direction, means for detecting the bright-dark boundaries at the mutually opposite edges of a bull's eye of said target, means for receiving a transmitted light or reflected light from said detecting means and generating hole center and bull's eye center signals;

(c) a second photoelectric detector system spaced from said first photoelectric detector system having means for transporting said second system transversely to the direction of movement of said target, means for detecting two mutually opposite hole edges of said target, means for detecting the bright-dark boundaries at the mutually opposite edge of a bull's eye of said target, means for receiving a transmitted light or reflected light from said detecting means into hole center and bull's eye center signals; and (d) means for converting bull's eye center signals, hole center signals into a rating for said target hits.

8. Apparatus according to claim 7 wherein said means for transporting said second detector system includes drive means with a travel pulse generator associated with said drive means.

9. Apparatus according to claim 8 wherein each photoelectric detector system for generating a hole center signal has a linear array of light sources on one side of the path of travel of the target and at least one linear array of light receivers on the other side of said path.

10. Apparatus according to claim 9 wherein each photoelectric detector system for generating a hole center signal comprises two parallel linear arrays of light receivers, which have a spacing that is approximately twice the diameter of the entry hole.

11. Apparatus according to claim 7 wherein each photoelectric detector system for generating a bull's eye center signal comprises at least one photoelectric detector, which is disposed on one side of the path of travel of the target and serves to detect reflected light.

12. Apparatus according to claim 11 wherein the photoelectric detectors for detecting reflected light travel in the directions of movement of the target and of the cross slide, respectively.

13. Apparatus according to claim 11 wherein at least one photoelectric detector for detecting reflected light is disposed on one side and at least a second photoelectric detector for detecting reflected light is disposed approximately symmetrically to the former on the opposite side of an imaginary center plane, which extends across the plane of travel of the target or of the cross slide at right angles thereto, each of said two photoelectric detectors for detecting reflected light has associated with it an additional light receiver, which is disposed on the opposite side of the plane of travel of the target and is arranged to generate a signal in response to a light ray which comes from the associated photoelectric detector for detecting reflected light and falls through an entry hole in the region in which the light ray is incident on the target, which signal suppresses the bull's eye center signal (Sx; Sy) of that photoelectric detector for detecting reflected light.

14. Apparatus according to any of claims 7 to 13 wherein said first and second photoelectric detector systems are mounted on the transporting means for said second detector system.

15. Apparatus according to claims 9 or 11 wherein the photoelectric detectors for detecting reflected light of both photoelectric detector systems precede the linear arrays of light sources and light receivers in the direction of movement of the target and of the second photoelectric detector system transport means, respectively.

* * * * *